United States Patent [19]

Vitonis

[11] 4,400,842

[45] Aug. 30, 1983

[54] DUSTING BRUSH ASSEMBLY FOR VENETIAN BLINDS AND THE LIKE

[76] Inventor: Frank Vitonis, 530 West Wilson, Costa Mesa, Calif. 92627

[21] Appl. No.: 340,307

[22] Filed: Jan. 18, 1982

[51] Int. Cl.[3] ..... A46B 17/00; A46B 17/04

[52] U.S. Cl. ..... 15/247; 15/210 A

[58] Field of Search ..... 15/142, 246, 247, 210 A, 15/257.1, 257.2, 257 R, 160; 206/361, 15.2, 15.3; 150/52 R

[56] References Cited

U.S. PATENT DOCUMENTS

| | | | |
|---|---|---|---|
| 2,134,965 | 11/1938 | Zbarsky | 15/210 A |
| 2,269,424 | 1/1942 | Bernstein | 15/247 X |
| 2,350,221 | 5/1944 | Eisenhut | 15/247 X |
| 2,533,829 | 12/1950 | Merryweather | 206/361 |
| 2,562,230 | 7/1951 | Bernbaum | 15/247 X |

*Primary Examiner*—Peter Feldman

*Attorney, Agent, or Firm*—Mahoney & Schick

[57] ABSTRACT

A preferably molded plastic brush frame extends transversely having an integral longitudinally extending, curvilinear handle and mounts a multiplicity of side by side, finger-like, preferably bristle brushes extending longitudinally therefrom. A preferably molded plastic cover closed at the bottom and side walls, and open at the top is dimensioned for receiving the brushes and a portion of the transverse frame downwardly therein to telescopically enclose the brushes. The cover extends longitudinally downwardly a greater distance than the brushes so as to form a dust chamber therein beneath the brushes. Preferably snap-fasteners are mounted transversely centrally between the frame portion and the cover at opposite sides thereof selectively engageable for retaining the frame portion and brushes in the cover and permitting shaking of the assembly to deposit dust from the brushes into the cover and dust chamber.

6 Claims, 5 Drawing Figures

DUSTING BRUSH ASSEMBLY FOR VENETIAN BLINDS AND THE LIKE

BACKGROUND OF THE INVENTION

This invention relates to a dusting brush assembly for venetian blinds and the like, and more particularly, to a brush having a transverse frame with a multiplicity of side by side, finger-like brushes extending longitudinally therefrom selectively assemblable with a cover longitudinally telescoping and enclosing a brush frame portion and the brushes. By providing fastener means between the brush frame portion and the cover in this assembled state, the overall assembly may be shaken to deposit dust from the brushes into the cover. Thus, the assembly not only offers means for storing the brush, but also means for removing collected dust from the brush after a cleaning operation.

It is well known that venetian blinds are a common window covering used in residences and business offices. It is also well known that in this environment, one of the major problems with the use of venetian blinds is the maintaining of the same clean in a relatively dust free condition. Due to the multiplicity of slats and the relatively close spacing required for venetian blinds, it is difficult to gain access to the slat surfaces upon which dust will naturally collect in order to remove the same. As a result, dusting of the venetian blind slats which is not infrequently required can be a quite tedious operation.

In order to minimize the foregoing dusting difficulties inherent in the use of the otherwise highly desirable and efficient venetian blinds, various forms of specially configured venetian blind dusting brushes have been heretofore provided. Probably the most prevalent form of dusting brush is that having a rigid, transverse frame with handle and mounting a multiplicity of side by side, finger-like brushes thereon extending to transversely oriented free ends. By holding the brush in one hand and inserting the free ends of the finger-like brushes between vertically adjacent of a number of the venetian blind slats, it is possible to move the brush along the slats to remove the dust from the surfaces thereof.

In order to maximize the convenience and efficiency of use of a dusting brush of this type for dusting venetian blinds, it must be kept in mind that selection of the composition and construction of the finger-like brushes is of importance. If the finger-like brushes are relatively stiff and will not absorb the dust therein, the dust from the slats is merely brushed from the blinds and will settle on the floor surface therebeneath requiring later removal. The most efficient form of brush, therefore, is that having the finger-like brushes of a soft, dust absorbing material so that the majority of the dust contacted is retained by the finger-like brushes.

This, however, presents an additional problem which requires solution. If the finger-like brushes are formed of materials which will temporarily retain the majority of the dust contacted thereon so as to prevent the dust from accumulating on the surrounding floor surfaces, even the best selected materials will only retain a given amount of dust so as to require relatively frequent dust removal therefrom. In view thereof, the additional problem presented and which has not been addressed by the prior dusting brushes for venetian blinds is exactly how to accomplish the frequently required accumulated dust removal from the finger-like brushes in a convenient manner and equally important, in a manner not resulting in the requirement of further exterior dust collecting operations.

OBJECTS AND SUMMARY OF THE INVENTION

It is, therefore, an object of this invention to provide a dusting brush assembly for venetian blinds and the like which not only includes a brush having the necessary dust absorbing and accumulating qualities, but also includes cover means specifically arranged for reception of the dust accumulating portions of the brush permitting the removal of dust from the brush while assembled therein. The brush may be of the form described having the transverse frame with handle and mounting the multiplicity of finger-like brushes thereon, the brushes being formed of the dust absorbing materials. The cover means is generally tubular with closed bottom and side walls, an open top dimensioned for receiving the finger-like brushes and a portion of the transverse frame downwardly therein. By providing a selectively engageable fastener between the cover means and a portion of the frame, the entire assembly of brush and cover may be shaken to dislodge and remove dust from the finger-like brushes with the same accumulating within the cover means. Thus, the problem of removing accumulated dust from the brush at frequent intervals is solved, the accumulated dust of the brush being deposited in the cover means for later convenient disposal.

It is a further object of this invention to provide a dusting brush assembly for venetian blinds and the like of the foregoing general nature and solving the problem of accumulated dust disposal wherein, in preferred embodiment form, the cover means may be longitudinally elongated spaced from the longitudinal extent of the finger-like brushes of the brush as assembled therein to form a lower dust chamber within the cover means for increased dust collection. Thus, when the finger-like brushes of the brush are assembled in the cover means and the overall assembly shaken to dislodge the accumulated dust from the finger-like brushes, the removed dust naturally falls downwardly and primarily collects in the cover means dust chamber. In this manner, a greater collection of dislodged dust can be accommodated by the cover means and the frequency of the final dust disposal operation from the assembly will be markedly decreased.

It is still another object of this invention to provide a dusting brush assembly for venetian blinds and the like which satisfies the foregoing objects in a simple and efficient manner by providing an assembly which may be manufactured for a relatively modest cost. Again, in preferred embodiment form, the brush frame with handle may be formed of one-piece molded plastic and the cover means likewise of one-piece molded plastic. The finger-like brushes of the brush may be of usual construction such as bristle brushes or other brush materials suitable for the intended use and common in the trade. To complete the assembly, the fastener or fasteners selectively engageable between the brush frame portion and cover means may be of usual snap-fastener form.

Other objects and advantages of the invention will be apparent from the following specification and the accompanying drawings which are for the purpose of illustration only.

DESCRIPTION OF THE BEST EMBODIMENT CONTEMPLATED

Figure 1:
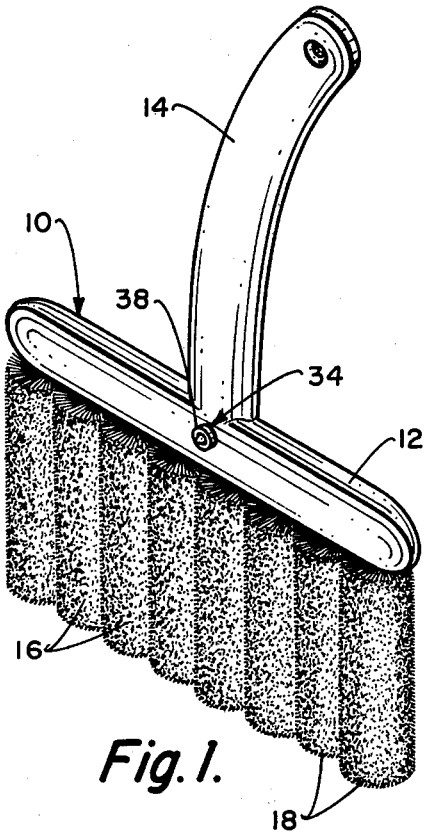
FIG. 1 is a perspective view of a preferred embodiment form of the dusting brush for venetian blinds forming a part of the assembly of the present invention.
Figure 2:
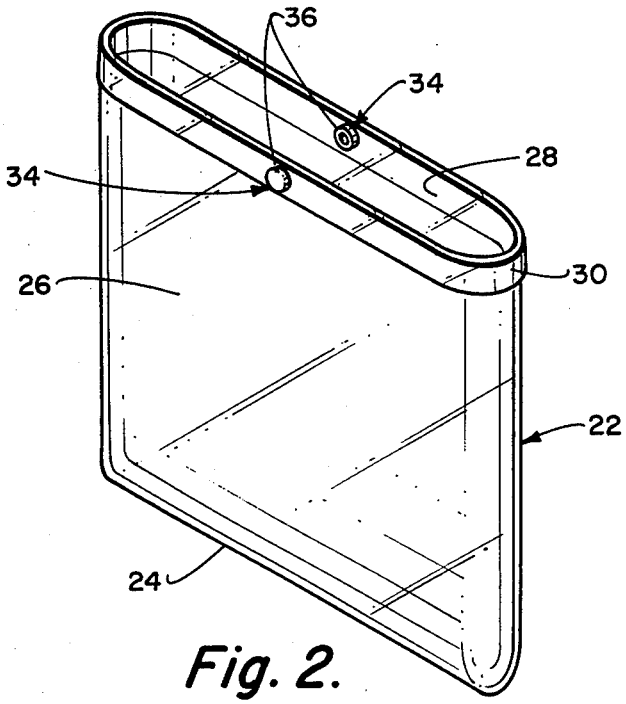
FIG. 2 is a perspective view of a preferred embodiment of the cover means of the assembly.

Referring to the drawings, a preferred embodiment of the dusting brush assembly for venetian blinds and the like is shown and includes a dusting brush generally indicated as 10 formed by a preferably one-piece, molded plastic frame 12 extending transversely and having an integral handle 14 projecting centrally and longitudinally curvilinearly therefrom. A multiplicity, in this case 8, finger-like brushes 16 are end mounted in the frame 12 positioned transversely side by side projecting longitudinally of the frame opposite the handle 14 and terminating longitudinally in free ends 18 generally transversely aligned. The finger-like brushes 16 may be of the relatively soft, dust absorbing type such as bristle brushes having wire centers 20 or other forms of brushes serving the intended purposes.

Figure 3:
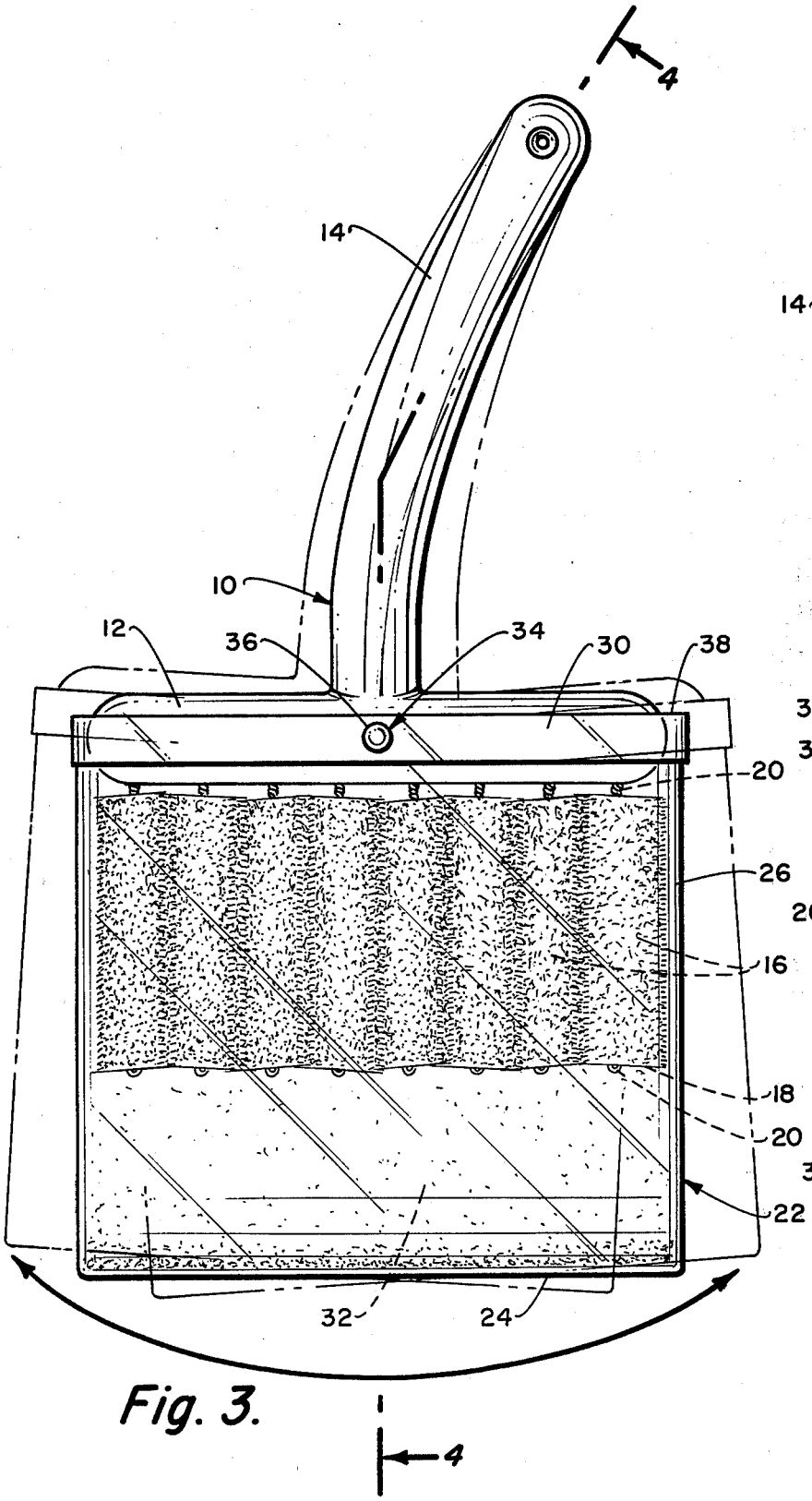
FIG. 3 is an enlarged, side elevational view of the brush and cover means assembly, phantom lines illustrating shaking motion of the assembly during a dust removal operation.
Figure 4:
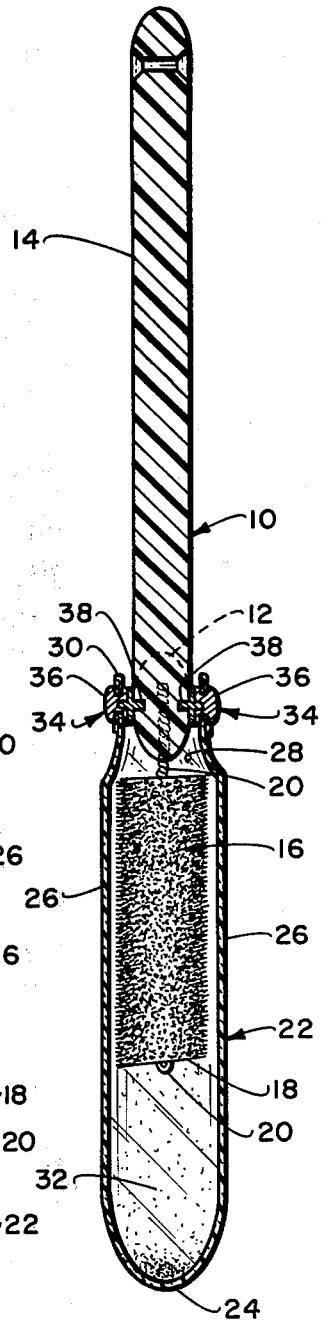
FIG. 4 is a sectional view looking in the direction of the arrows 4—4 in FIG. 3.

Important to the principals of the present invention, the assembly further includes a cover generally indicated as 22 which is tubular and is likewise preferrably molded of one-piece plastic. The cover 22 has a closed bottom wall 24, closed side walls 26 and an open top 28, the top being surrounded by a thickened collar 30. Furthermore, the cover 22 is dimensioned for telescopically receiving the finger-like brushes 16 and a portion of the transverse frame 12 of the dusting brush 10 longitudinally downwardly therein as illustrated in FIGS. 3 and 4 so that the cover with the assistance of the dusting brush frame portion effectively encloses the finger-like brushes 16 of the dusting brush therein. It will be noted that in such assembly of the dusting brush 10 and cover 22, the cover is longitudinally elongated over the extension of the finger-like brushes 16 of the dusting brush 10 thereby spacing the cover bottom wall 24 downwardly from the finger-like brush free ends 18 to form a dust chamber 32 beneath the dusting brush 10.

Equally important to the present invention, selectively engageable fastener means, preferably in the form of a pair of snap-fasteners generally indicated at 34 are centrally mounted at opposite sides between the portion of the dusting brush frame 12 and the cover 22. As shown, fastener male portions 36 are mounted on and project through the collar 30 of the cover 22, and fastener female portions 38 are mounted aligned with the male portions in the dusting brush frame 12. Thus, in the assembly of FIGS. 3 and 4, the snap-fasteners 34 are engaged so that the dusting brush 10 and cover 22 will move as a unit for a purpose to be hereinafter pointed out, and the snap-fasteners may be selectively disengaged for removal of the dusting brush from the cover to permit functioning of the dusting brush for its intended purpose.

In use of the dusting brush assembly of the present invention, the dusting brush 10 will normally be stored in the cover 22 with the snap-fasteners 34 engaged retaining the assembly for convenient storage. When it is desired to use the dusting brush 10 for dusting venetian blinds, the assembly is removed from storage and the snap fasteners 34 disengaged permitting convenient removal of the dusting brush 10 from the cover 22. This places the dusting brush 10 in free standing condition ready for use as shown in FIG. 1.

Figure 5:
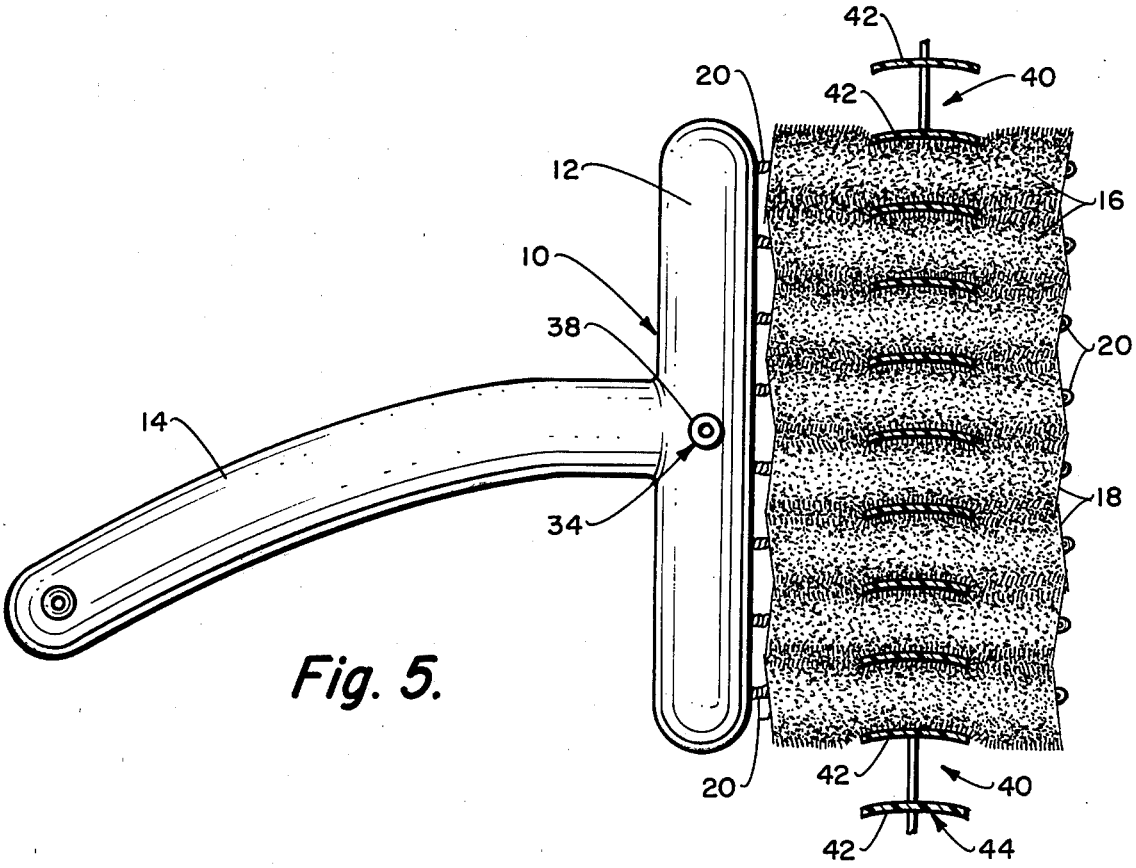
FIG. 5 is a side elevational view of the brush inserted in operational dust removal position between the slats of a typical venetian blind, the venetian blind being shown in vertical section.

In use for its intended purpose, the dusting brush 10 is grasped by the handle 14 and the finger-like brushes 16 thereof, as shown in FIG. 5, are inserted through spaces 40 between horizontally extending slats 42 of a conventionally vertically hanging venetian blind generally indicated at 44. Normally, one of the finger-like brushes 16 will be positioned in the space 40 between vertically adjacent slats 42 so that a multiplicity of slats may be simultaneously dusted. The dusting is accomplished merely by moving the dusting brush 10 horizontally from one end of the slats 42 to the other, after which, the dusting brush is removed and similarly reinserted at a vertically adjacent location of the venetian blind 44.

During this use of the dusting brush 10 for carrying out the dusting operations and with the finger-like brushes 16 thereof formed of the ideal dust absorbing materials, substantially all of the dust on the venetian blind slats 42 will be absorbed into the finger-like brushes. Thus, after a period of operation, the finger-like brushes 16 of the dusting brush 10 will become dust saturated. When this occurs, the dusting brush 10 is removed from the venetian blind 44 and inserted into the cover 22 with the snap-fasteners 34 selectively engaged in the manner illustrated in FIGS. 3 and 4.

This assembly presents the assembly as a unitary assembly which can be shaken as illustrated in phantom lines in FIG. 3. Shaking of the assembly causes the accumulated dust to fall free of the finger-like brushes 16 and downwardly of the cover 22 into the cover dust chamber 32 ultimately providing the dusting brush 10 in a relatively dust free condition. The snap-fasteners 34 of the assembly are then once again disengaged and the dusting brush 10 removed from the cover 22, the dusting brush then being in a relatively clean condition ready for continuation of the dusting of the venetian blind slats 42.

It can be seen, therefore, that the dusting brush 10 may be conveniently used for carrying out an efficient dusting operation of the venetian blind slats 42 and the dust accumulated on the finger-like brushes 16 thereof periodically during such dusting operation deposited directly into the cover 22. This obviously eliminates the problem of where to deposit accumulated dust during such operation. It furthermore eliminates the necessity of later further cleaning dust from adjacent floor and other surfaces as was required by the prior dusting brush constructions.

Although a preferred embodiment of the dusting brush assembly for venetian blinds and the like of the present invention has been illustrated and described herein, it is pointed out that it is not intended to limit the principals of the present invention to the specific construction and combination shown. It is obvious to those skilled in the art that various substitutions and alterations may be made while still incorporating the inventive principals of the present invention. Thus, the principals of the present invention should be broadly construed and only modified within the express limitations of the appended claims including the patent equivalence thereof.

I claim:

1. A dusting brush assembly for venetian blinds and the like comprising: a transverse brush frame having rigid handle a multiplicity of side by side finger-like brushes extending longitudinally therefrom; cover means having closed bottom and side walls and an open top for selectively receiving said brushes and a portion of said frame downwardly therein to telescopically enclose said brushes, said bottom and side walls of said cover means being longitudinally extended beyond longitudinally lengths of said brushes as positioned in said cover means; a fastener selectively engageable between said cover means and said brush frame portion retaining said frame portion and brushes therein permitting shaking of assembly of said brush frame and brushes enclosed by said cover means to deposit dust from said brushes into said cover means and into a longitudinally extended dust chamber in said cover means, said fastener having one portion thereof secured to said cover means and another portion thereof secured into said transverse frame portion.

2. A dusting brush assembly as defined in claim 1 in which said fastener selectively engageable between said cover means and said brush frame portion is a snap-fastener partially secured on said cover means and partially secured into said frame portion selectively engageable.

3. A dusting brush assembly as defined in claim 1 in which said fastener selectively engageable between said cover means and said brush frame portion is one of two fasteners at opposite sides of said cover means and said frame portion generally transversely aligned.

4. A dusting brush assembly as defined in claim 1 in which said fastener selectively engageable between said cover means and said brush frame portion is one of two fasteners at opposite sides of said cover means and said frame portion generally transversely aligned, said fasteners being located generally transversely centrally of said cover means and frame portion.

5. A dusting brush assembly as defined in claim 1 in which said fastener selectively engageable between said cover means and said brush frame portion is one of two fasteners at opposite sides of said cover means and said frame portion generally transversely aligned, said fasteners being located generally transversely centrally of said cover means and frame portion; and in which said fasteners are snap-fasteners each partially secured on said cover means and partially secured into said frame portion selectively engageable.

6. A dusting brush assembly as defined in claim 1 in which both said brush frame and said cover means are molded of plastic.

* * * * *